US006227365B1

(12) United States Patent
Gary

(10) Patent No.: US 6,227,365 B1
(45) Date of Patent: May 8, 2001

(54) MOLDED PRODUCT DISPLAY SYSTEM

(75) Inventor: Lonnie F. Gary, Ransom Canyon, TX (US)

(73) Assignee: Gary Products Group, Inc., Lubbock, TX (US)

( * ) Notice: Subject to any disclaimer, the term of this patent is extended or adjusted under 35 U.S.C. 154(b) by 0 days.

(21) Appl. No.: 09/532,355

(22) Filed: Mar. 21, 2000

Related U.S. Application Data

(63) Continuation of application No. 09/169,802, filed on Sep. 30, 1998, now abandoned, which is a continuation-in-part of application No. 29/089,663, filed on Jun. 19, 1998, now Pat. No. Des. 422,203, and a continuation-in-part of application No. 29/089,689, filed on Jun. 19, 1998, now Pat. No. Des. 414,291.

(51) Int. Cl.[7] ..... B65D 85/24

(52) U.S. Cl. ..... 206/340; 206/345; 206/806; 206/820

(58) Field of Search ..... 206/418–420, 206/421, 461, 486, 489, 477, 478, 480, 482, 338–347, 806, 820

(56) References Cited

U.S. PATENT DOCUMENTS

| | | | | |
|---|---|---|---|---|
| D. 376,535 | | 12/1996 | Gary et al. . | |
| 4,341,303 | | 7/1982 | Britt . | |
| 4,946,386 | * | 8/1990 | Kidd et al. | 206/820 |
| 5,042,535 | * | 8/1991 | Schlottke | 206/820 |
| 5,090,570 | | 2/1992 | Todd . | |
| 5,509,532 | | 4/1996 | Brody . | |
| 5,511,661 | | 4/1996 | Karlis et al. . | |
| 5,520,281 | * | 5/1996 | Huang | 206/820 |
| 5,593,036 | | 1/1997 | Dyble et al. . | |
| 5,649,621 | | 7/1997 | Brody . | |
| 5,653,339 | | 8/1997 | Dobson . | |
| 5,733,308 | | 3/1998 | Daugherty et al. . | |

* cited by examiner

*Primary Examiner*—Luan K. Bui
(74) *Attorney, Agent, or Firm*—Locke Liddell & Sapp LLP; Monty L. Ross

(57) ABSTRACT

A molded product display system having an array-of interconnected, tearably releasable, molded plastic parts, and a display card that is preferably supported by the array of plastic parts for display of the parts at the point of sale. The array of molded parts preferably includes a molded section defining an aperture usable for hanging the molded product display system from a support rod or other hanger at the point of sale. The display card preferably includes a plurality of apertures or slits useful for releasably attaching the display card to the array of molded parts.

13 Claims, 4 Drawing Sheets

MOLDED PRODUCT DISPLAY SYSTEM

CROSS-REFERENCE TO RELATED APPLICATIONS

This application is a continuation of U.S. Ser. No 09/169,802, filed Sep. 30, 1998, now abandoned, which is a continuation-in-part of application Ser. No. 29/089663, now U.S. Pat. No. D,422,203 and Ser. No. 29/089689, now U.S. Pat. No. D,414,291, both filed Jun. 19, 1998.

BACKGROUND OF THE INVENTION

1. Field of the Invention

This invention relates to a product display system for molded plastic parts. More particularly, the present invention relates to a point of sale display system for molded plastic parts that comprises the combination of an array of interconnected elements including a plurality of tearably releasable, molded plastic parts, and a display card that is self-attachable to and carried by the array of elements.

2. Description of Related Art

In the past, molded plastic parts were sometimes attached to punched, slotted and/or folded display cards for display at retail stores. Some products, such as molded plastic rulers and protractors, for example, were held in place by inserting portions through slots, under tabs, or into pockets formed in the display cards. Other products were attached to display cards using twist-ties that passed over the product, through the card, and were then twisted together on the back side of the card. Some display systems used a combination of both approaches. The use of polymeric bags and blister packs for attaching products to display cards is also well known. The bags and blisters used for such purposes are usually made of a clear plastic material and are attached by adhesive, staples, or the like, to the display card. The blister portion of a package is sometimes made in two hinged portions that fold together to surround the product, and is referred to as a clamshell. Sometimes the display card is folded, and flanges of the blister are secured by an adhesive disposed between the two folded layers. U.S. Pat. Nos. 5,509,532 and 5,649,621 disclose a display system for a plastic product wherein the part is molded in a butterfly configuration with a living hinge joining two opposed halves, and means are provided for self-attaching a foldable display card to the product.

With each of the prior art display systems described above, the display cards are typically stamped or punched with a hole or slot that is centrally disposed near the top of the card. The hole or slot allows the card to slide over a support rod or hanger attached to a shelf, pegboard or other display rack or panel on which merchandise is displayed at the point of sale. However, a principal disadvantage experienced with conventional molded product display systems is that the weight of the product is carried by the display card. Display cards are typically made of cellulosic cardstock that is susceptible to tearing. Whenever such packages are handled by store personnel or by customers at the point of sale, it is not unusual for the display cards to be torn, or for the hole or slot supporting the card and product to be ripped out, or for the products to become detached from the display cards, causing the package to become less salable.

Another disadvantage that has been experienced with the use of such conventional display systems for molded plastic products relates to the thickness of the packaged product. When several molded plastic articles are packaged in a bag or blister pack, particularly where the molded products are not nestable, the resultant thickness of the overall package may substantially reduce the number of packages and pieces of product that can be shipped in a container of a given size or displayed on a conventional support rod or hanger at the point of sale. With conventional display systems, the card area available for graphics and printing is generally limited.

Another disadvantage that has been experienced in marketing injection molded plastic products relates to the mold runners that are typically formed when such products are manufactured in a multi-cavity mold. These runners are formed when streams of melted plastic solidify in flow channels that interconnect and feed plastic to the various cavities of a mold. This solidification normally occurs as the molded parts cool inside the cavities in the mold platens prior to ejecting the parts from the mold cavities. Although it is possible to produce multiple parts from a multi-cavity mold without forming interconnecting runners by using additional gates or "hot runner" technology, the associated tooling costs are substantially higher than for "cold runner" tools.

Where multiple parts or products are injection molded with interconnecting runners, the runners are usually removed prior to packaging. Some molded products, such as model airplane parts, are packaged inside a box while still attached to the runners. Other molded products have been marketed by placing them in poly bags while still attached to the runners. U.S. Pat. No. 5,733,308 discloses a suture pledget dispensing system where the pledgets are molded in such manner that they can be tearably released from one or more runners, or from each other, or from a card which is a part of a package. Here again, however, the product-runner combination is shown (FIG. 8) packaged inside a blister pack.

A molded product display system is therefore needed that can be suspended from conventional support rods and hangers, and includes a display card with increased area for presentation of text and graphics, but that does not have the disadvantages associated with conventional display systems as described above. A display system for molded plastic products is also needed that can be used for displaying such products while still attached to a mold runner without fasteners or adhesives, and without the need for another external package such as a box, bag or blister pack.

SUMMARY OF THE INVENTION

The molded product display system disclosed herein preferably comprises a molded product portion and a display card portion. The molded product portion preferably further comprises a plurality of interconnected, tearably releasable, molded plastic parts joined together in an array by attachment to one or more runners, to one or more other of such parts, or to both. According to a particularly preferred embodiment of the invention, the molded product portion further comprises a molded product support member that is firmly connected to at least one runner, and can be used to hang the molded product and display card from a support rod or hanger.

The display card portion of the invention is preferably carried and supported by the molded product portion. Although this function can be achieved using various structures within the scope of the invention, the display card portion preferably comprises a plurality of spaced apertures adapted to receive resilient parts of the molded product portion to thereby maintain and support the card in substantially fixed relation to the molded product portion. As used herein, the term "substantially fixed relation" includes permitting some limited movement, but restricting the display card portion from falling away or separating from the molded product portion without the exertion of manual force on the molded product portion, the display card portion, or both.

Alternatively, the display card portion can comprise a plurality of apertures that are linked by slits (or slots) to at least one edge of the card. When constructed in this manner, and providing that the apertures and slits are appropriately sized and located, the display card can be pressed against the molded product portion, and the slit portions will temporarily separate to permit a structural member of the molded product portion to be received within an aperture in the display card, after which the slit will again return to a more closed position, thereby causing the display card portion to be held in place relative to the molded product portion.

In one particularly preferred embodiment of the invention, the molded product portion further comprises a plurality of injection molded plastic clips useful for supporting decorative light strings and other related products on a building structure. The molded plastic clips preferably each have two points of connection or attachment to runner elements, or tabs connected to runner elements, and can be easily separated from the runner elements by the purchaser prior to use.

With any of the alternatives described above, the display card portion of the subject molded product display system is held in substantially fixed relation to the molded product portion, and in another particularly preferred embodiment, the display card portion does not carry the weight of the molded product portion whenever the molded product display system is suspended from a support rod or other hanger at the point of sale.

BRIEF DESCRIPTION OF THE DRAWINGS

The apparatus of the invention is further described and explained in relation to the following figures of the drawings wherein.

Like reference numerals are used to indicate like parts in all figures of the drawings.

DESCRIPTION OF THE PREFERRED EMBODIMENTS

Figure 3:
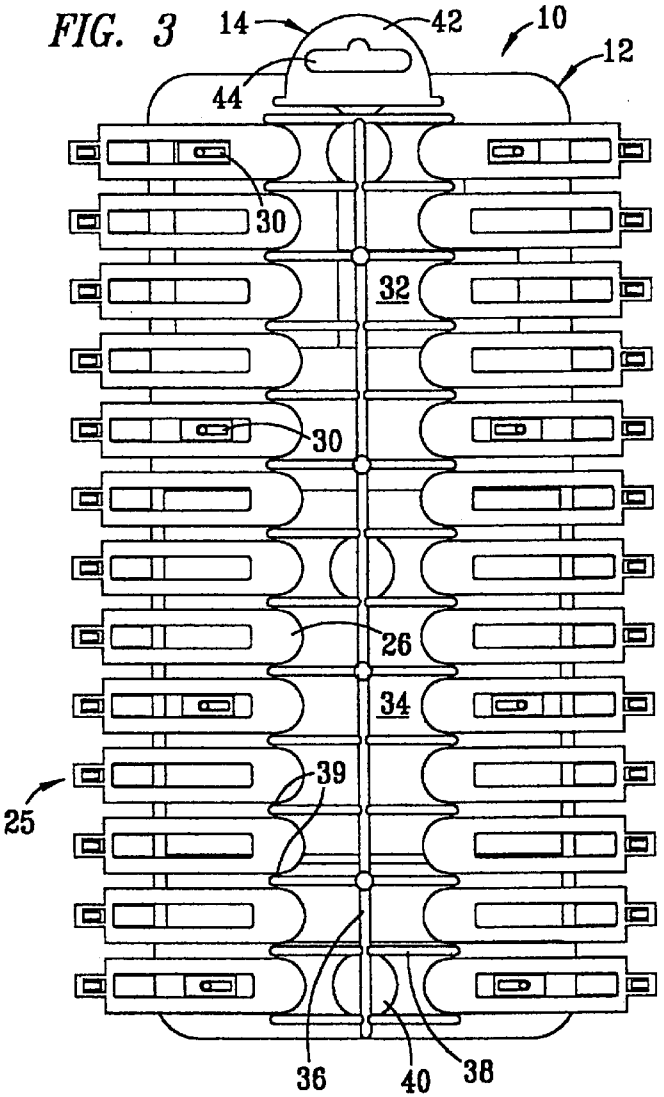
FIG. 3 is a rear elevation view of the molded product display system of FIG. 1.
Figure 1:
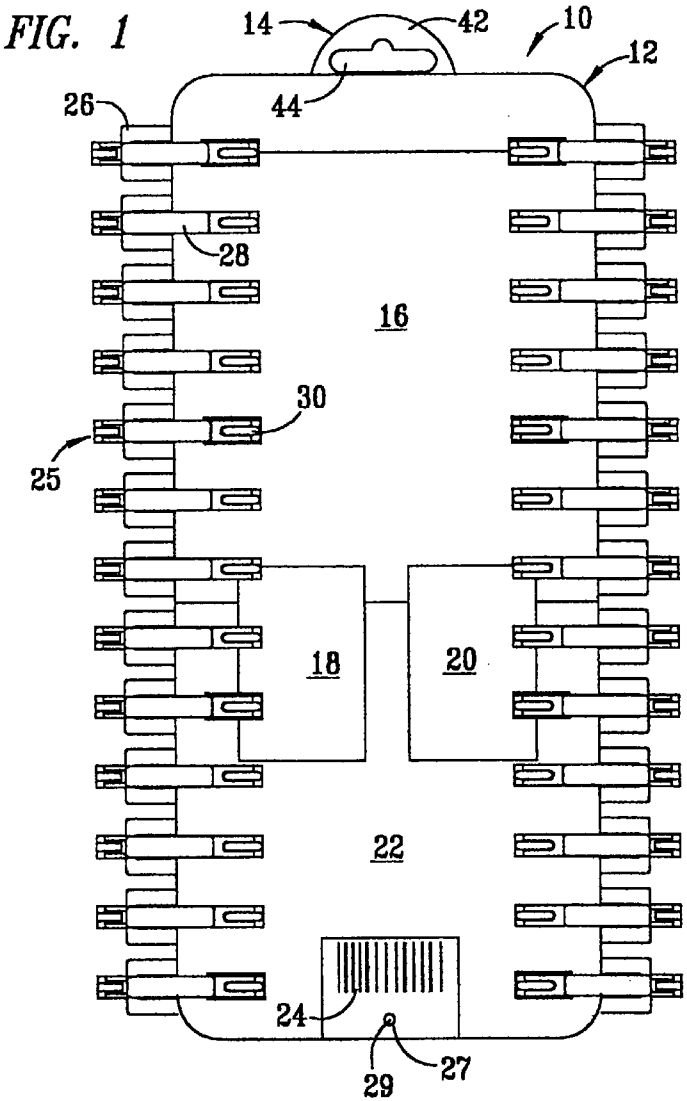
FIG. 1 is a front elevation view of one preferred embodiment of the molded product play system of the invention.
Figure 4:
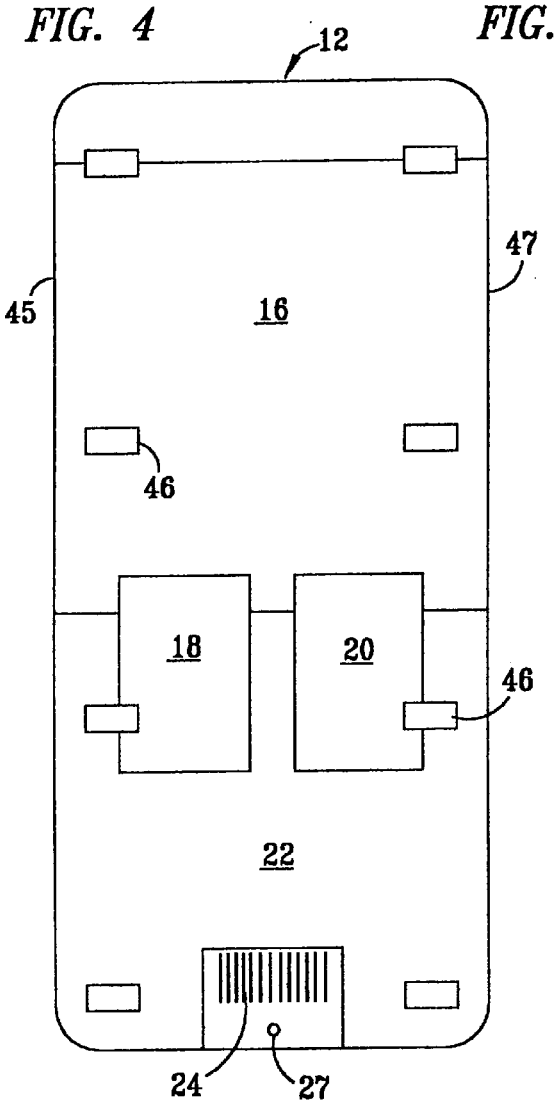
FIG. 4 is a front elevation view of the display card portion of the molded product display system of FIG. 1.
Figure 5:
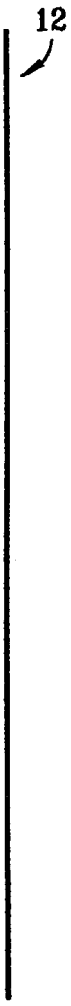
FIG. 5 is a side elevation view of the display card portion of the molded product display system of FIG. 1.

Referring to FIGS. 1–6 and 13, molded product display system 10 of the invention preferably comprises display card portion 12 and molded product portion 14. Display card 12 is preferably made of cardstock having more stiffness or rigidity than paper, and preferably has front-facing and back-facing major surfaces that are susceptible to being printed with photos, graphics or text in either color or black-and-white as desired. The surface appearance can be dull or shiny, and coated by conventional, commercially available means. Sectors or panels 16, 18, 20 and 22 as shown in FIGS. 1 and 4 are merely illustrative of one way in which the front-facing surface of display card 12 can be subdivided into multiple areas for presenting various photos, drawings, text blocks, or the like. Similarly, for illustrative purposes, the back-facing surface of display card 12 is depicted as being subdivided into sectors 32, 34, 48, 50 and 52. A UPC code 24 can be printed on either the front- or back-facing surface as desired.

Other materials can also be used within the scope of the invention for making display card 12. Thus, for example, plastic sheeting can be used as an alternative substrate material, and printed paper labels can be attached to front and back surfaces if desired. The size, shape and thickness of display card 12 will depend upon the size and shape of the molded product portion 14 with which it is to be used. Because, according to the preferred embodiments of the invention, the weight of the molded product portion 14 is not supported by display card 12 when the molded product display system 10 is displayed at the point of sale, the thickness of display card 12 may be less than would otherwise be required to avoid unintended ripping or tearing of the card by store personnel or customers while stocking or handling the product.

Figure 6:
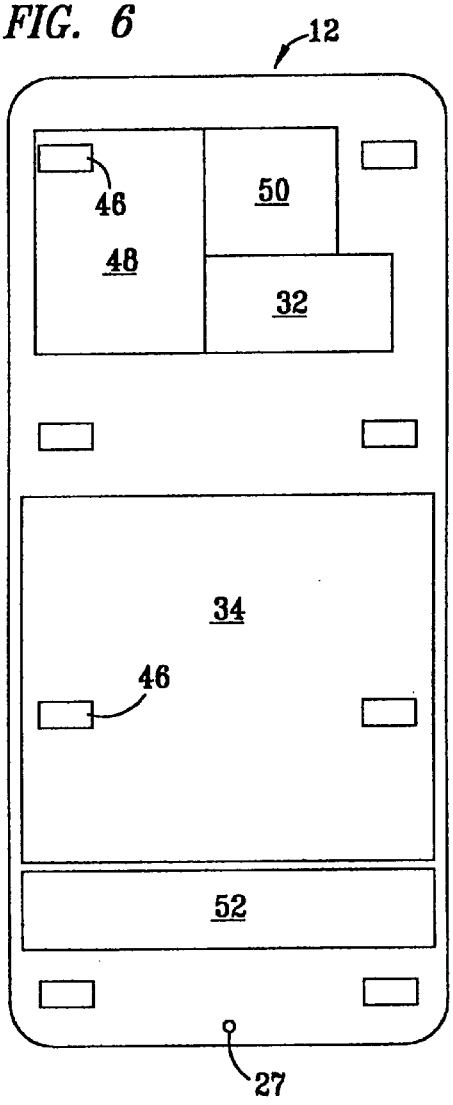
FIG. 6 is a rear elevation view of the display card portion of the molded product display system of FIG. 1.
Figure 9:
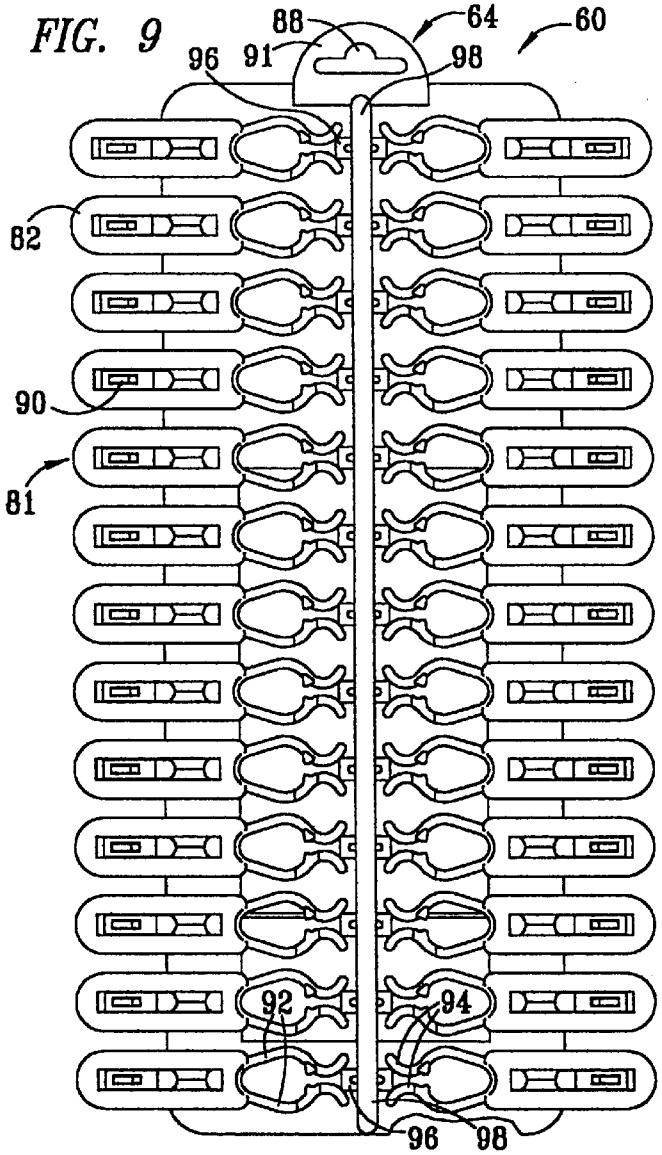
FIG. 9 is a rear elevation view of the molded product display system of FIG. 7.

As shown in FIGS. 4 and 6, display card 12 preferably further comprises a plurality of spaced-apart, rectangular apertures 46 that are longitudinally aligned on each side of the card. The size, shape and positioning of the apertures on display card 12, as depicted in this embodiment of the invention, are selected to cooperate with the size, shape and positioning of resilient molded hook portions 30 of some molded plastic clips .25 of molded product portion 14, as discussed in greater detail below. According to a particularly preferred embodiment of the invention, display card 12 further comprises aperture 27, the function of which is also described below in relation to molded product portion 14.

Figure 2:
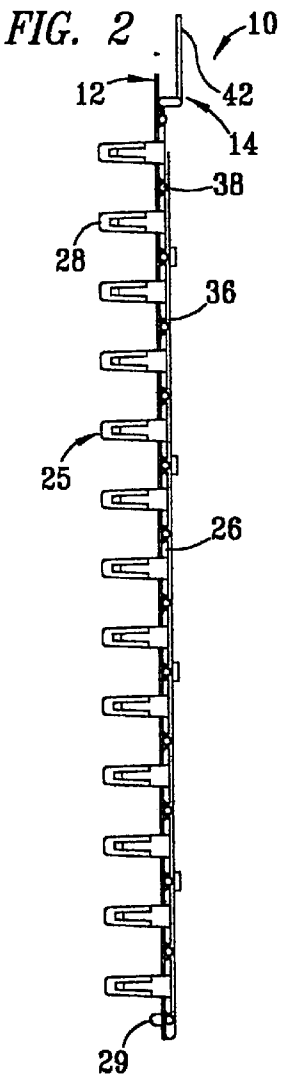
FIG. 2 is a right side elevation view of the molded product display system of FIG. 1.

Referring to FIGS. 1–3, molded product portion 14 preferably comprises an array of interconnected elements including a plurality of molded plastic parts. According to a preferred embodiment of the invention, the plastic parts are made using any moldable polymeric resin suitable for the application intended for the resultant part. Such resins can include, for example, polypropylene, acrylic, flexible PVC, nylon, polycarbonate, polystyrene, or the like. Although injection molded plastic parts are preferred for use in making molded product display system 10 of the invention, other molding processes such as thermo compression molding and vacuum forming can also be used with some products to produce molded product portion 14 within the scope of the invention. As used herein, the term "interconnected elements" is intended to refer to the joined of a plastic part to at least one other plastic part, or to the joinder of a plastic part to at least one runner, or to the joinder of a plastic part to both another plastic part and to a runner, by means such as a tab, web or strand that can be manually torn or twisted in two by a user without significant difficulty.

According to a preferred embodiment of the invention, molded product portion 14 comprises a centrally disposed, molded polymeric runner system having a plurality of molded plastic parts connected to the runner system by integrally molded, tearably releasable tabs, webs or strands. Referring to the particular embodiment disclosed in FIGS. 1–3, molded product portion 14 further comprises a centrally disposed, longitudinal rib 36 having a plurality of integrally molded lateral ribs 38 disposed transverse thereto. The length of longitudinal rib 36 is approximately equal to the length of display card portion 12, and lateral ribs 38 are substantially coplanar with longitudinal rib 36 to form a resultant molded structure that is relatively flat.

According to a particularly preferred embodiment of the invention, product support member 42 is integrally connected to the top end of longitudinal rib 36, and is provided with aperture 44 adapted to fit over a product support rod or hanger such as those found on conventional display racks. The connection between product support member 42 and longitudinal rib 36 is preferably sufficiently strong that product support member 42 can support the weight of molded product display system 10 without separation, and that these two elements of molded product portion 14 will not be torn apart during normal conditions of use of molded product display system 10.

According to another particularly preferred embodiment of the invention, a registration member such as outwardly projecting cylindrical plastic post 29 which is connected to longitudinal runner 36 in such manner that one end of post 29 extends, most preferably, perpendicularly from longitudinal rib 36 through a cooperating structure in display card 12 that is alignable with the registration member to position display card 12 relative to molded product portion 14. A preferred cooperating structure is aperture 27 in display card 12 whenever display card 12 and molded product portion 14 are engaged as depicted in FIGS. 1–3 and 13 to form molded product display system 10 of the invention. Although only one centrally disposed post is shown in FIGS. 1–3 and 13, it will be appreciated by those of ordinary skill in the art upon reading this disclosure that additional registration members extending forwardly away from longitudinal rib 36 and lateral ribs 38 can also be provided for use in maintaining positional stability of display card 12 relative to molded product portion 14, if desired. In such case, additional cooperatively aligned apertures can also be provided in display card 12 to receive such registration members.

Figure 13:
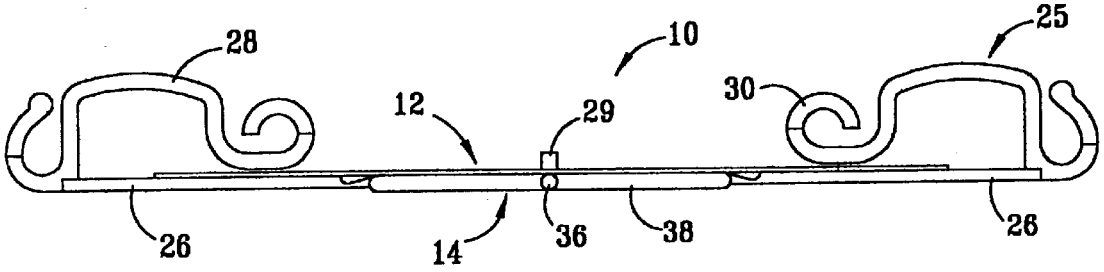
FIG. 13 is a bottom view of the molded product display system of FIG. 1.

As shown in FIGS. 1–3 and 13, molded product portion 14 preferably further comprises a plurality of molded plastic parts, clips 25, that are each connected at two attachment points 39 to lateral ribs 38. Molded plastic clips 25 are more completely depicted in Ser. No. 29/089663, filed Jun. 19, 1998, which is incorporated herein by reference, and are particularly useful for suspending decorative light strings to create icicle lighting effects. Each molded plastic clip 25 further comprises base member 26, a resilient hook support arm 28 connected at one end to base member 26, and a resilient hook portion 30 disposed at the free end of hook support arm 28. Clips 25 are preferably molded together with longitudinal runner 36 and lateral runners 38 in an array comprising a single layer of molded plastic products, and are oriented in such manner that base members 26 are substantially coplanar. Although, as seen in FIGS. 2 and 13, the thickness of clips 25 and the overall thickness of molded product portion 14 are substantially greater than the thickness of display card 12, the total thickness of molded product display system 10 is less than might be experienced, for example, with a display system of comparable length and width, and having a blister pack containing the same number of clips 25.

The attachment of display card 12 to molded product portion 14 is further described in relation to FIGS. 1–4 and 13. During the assembly of molded product display system 10 at the point of manufacture, display card 12 is desirably aligned with molded product portion 14 and inserted from the lower end between the resilient hooks 30 and base members 26 so that hooks 30 register with apertures 46 where provided. The use of plates or rods to provide separation between hooks 30 and base members 26 will facilitate insertion of display card 12, although any suitable means, including manual insertion, can be used if desired. When properly aligned, apertures 46 of display card 12 receive the resilient hooks 30 aligned therewith, resilient hooks 30 relax or settle into apertures 46, and aperture 27 registers over post 29 thereby securing display card 12 to molded product portion 14. It will be understood that other similarly effective registration members and cooperating structures can also be used within the scope of the invention for positioning display card 12 relative to molded product portions 14.

Figure 10:
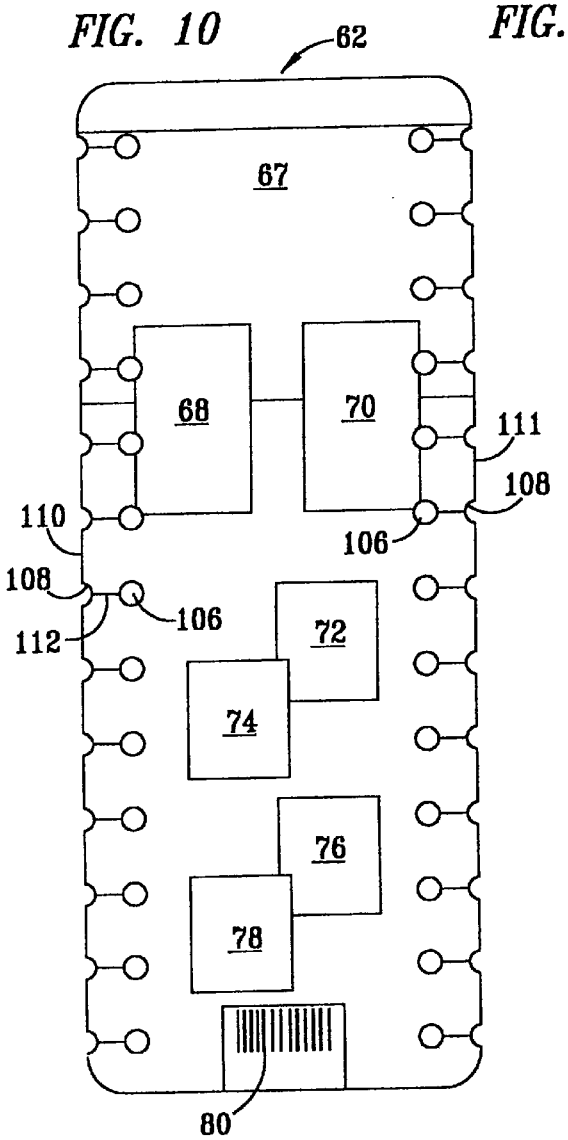
FIG. 10 is a front elevation view of the display card portion of the molded product display system of FIG. 7.
Figure 11:
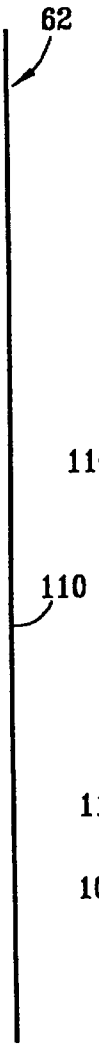
FIG. 11 is a side elevation view of the display card portion of the molded product display system of FIG. 7.
Figure 12:
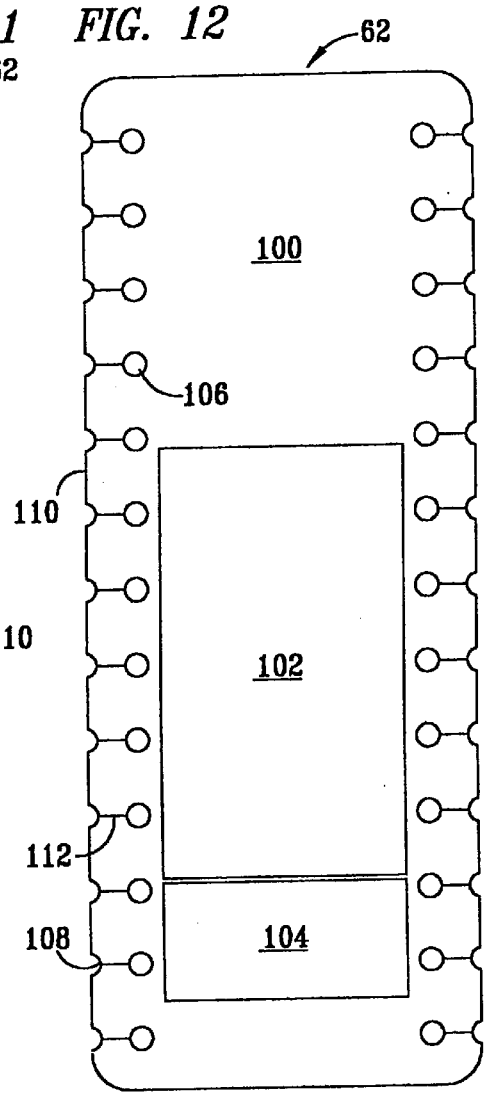
FIG. 12 is a rear elevation view of the display card portion of the molded product display system of FIG. 7.

Referring to FIGS. 7–12 and 14, molded product display system 60 of the invention preferably comprises display card portion 62 and molded product portion 64. Display card 62 is preferably made of cardstock having more stiffness or rigidity than paper, and preferably has front-facing and back-facing major surfaces that are susceptible to being printed with photos, graphics or text in either color or black-and-white as desired. The surface appearance can be dull or shiny, and coated by conventional, commercially available means. Sectors or panels 68, 70, 72, 74, 76 and 78 as shown in FIGS. 10 and 12 are merely illustrative of one way in which the front-facing surface of display card 62 can be subdivided into multiple areas for presenting various photos, drawings, text blocks, or the like. Similarly, for illustrative purposes, the back-facing surface of display card 62 is depicted as being subdivided into sectors 100, 102 and 104. A UPC code 80 can be printed on either the front- or back-facing surface as desired. Other materials can also be used within the scope of the invention for making display card 62. Thus, for example, plastic sheeting can be used as an alternative substrate material, and printed paper labels can be attached to front and back surfaces if desired. The size, shape and thickness of display card 62 will depend upon the size and shape of the molded product portion 64 with which it is to be used. Because, according to the preferred embodiments of the invention, the weight of the molded product portion 64 is not supported by display card 62 when the molded product display system 60 is displayed at the point of sale, the thickness of display card 62 may be less than would otherwise be required to avoid unintended ripping or tearing of the card by store personnel or customers while stocking or handling the product.

As shown in FIGS. 10 and 12, display card 62 preferably further comprises a plurality of spaced-apart, apertures 106 that are longitudinally aligned on each side of the card. Slits 112 preferably connect apertures 106 to recesses 108 along edges 110, 111. The size, shape and positioning of apertures 106, recesses 108 and slits 112 on display card 62, as depicted in this embodiment of the invention, are selected to cooperate with the size, shape and positioning of resilient arms 84 and posts 86 of molded plastic clips 81 of molded product portion 64, as discussed in greater detail below.

Referring to FIGS. 7–9 and 14, molded product portion 64 preferably comprises an array of interconnected elements including a plurality of molded plastic parts. According to a preferred embodiment of the invention, the plastic parts are made using any moldable polymeric resin suitable for the application intended for the resultant part. Such resins can include, for example, polypropylene, acrylic, flexible PVC, nylon, polycarbonate, polystyrene, or the like. Although injection molded plastic parts are preferred for use in making molded product display system 60 of the invention, other molding processes such as thermocompression molding and vacuum forming can also be used with some products to produce molded product portion 64 within the scope of the invention. As used herein, the term "interconnected elements" is intended to refer to the joinder of a plastic part to at least one other plastic part, or to the joinder of a plastic part to at least one runner, or to the joinder of a plastic part to both another plastic part and to a runner, by means such as a tab, web or strand that can be manually torn or twisted in two by a user without significant difficulty.

According to a preferred embodiment of the invention, molded product portion 64 comprises a centrally disposed, longitudinally extending, molded polymeric runner 98 having a plurality of molded plastic parts connected to runner 98 by integrally molded, tearably releasable tabs 96. The length of runner 98 is approximately equal to the length of display card portion 62. According to a particularly preferred embodiment of the invention, product support member 91 is integrally connected to the top end of longitudinal runner 98, and is provided with aperture 88 adapted to fit over a product support rod or hanger such as those found on conventional display racks. The connection between product support member 88 and longitudinal runner 98 is preferably sufficiently strong that product support member 91 can support the weight of molded product display system 60 without separation, and that these two elements of molded product portion 64 will not be torn apart during normal conditions of use of molded product display system 60.

Figure 8:
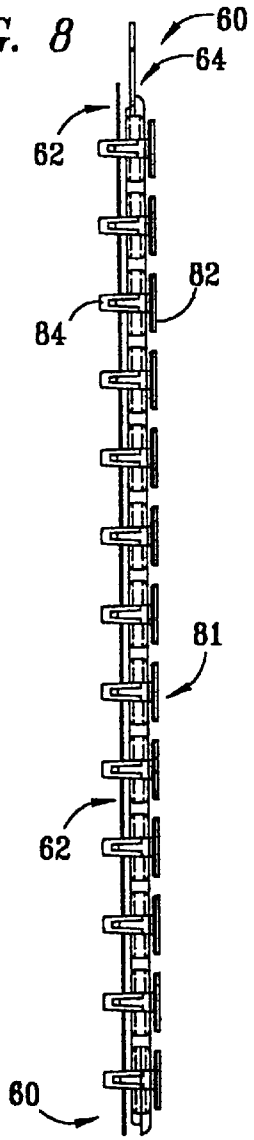
FIG. 8 is a right side elevation view of the molded product display system of FIG.7.
Figure 7:
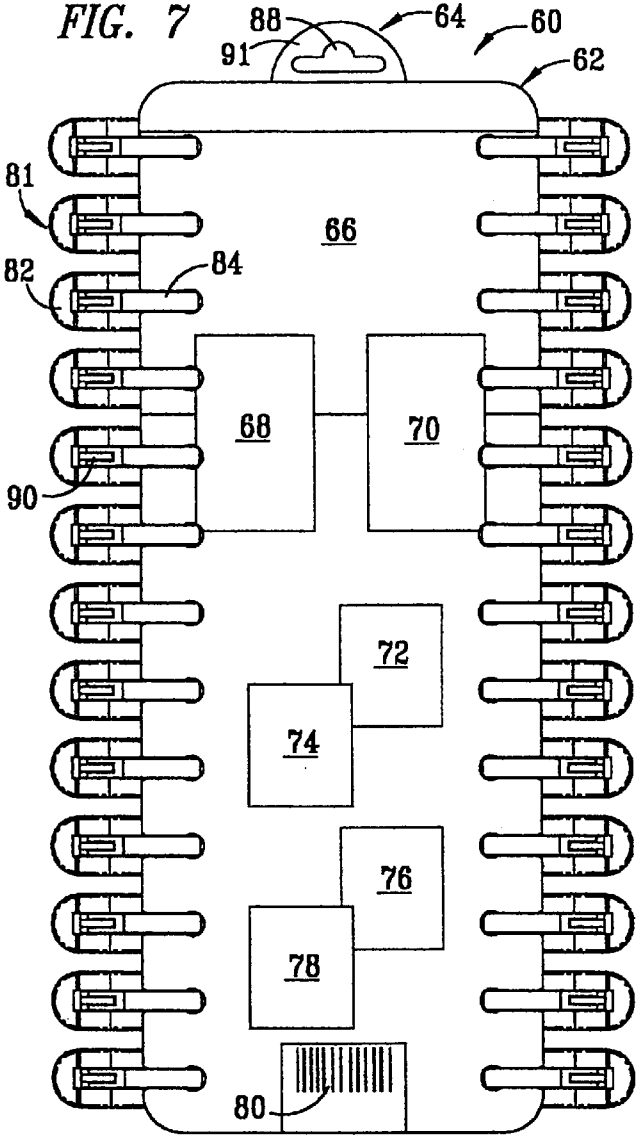
FIG. 7 is a front elevation view of another preferred embodiment of the molded product display system of the invention.
Figure 14:
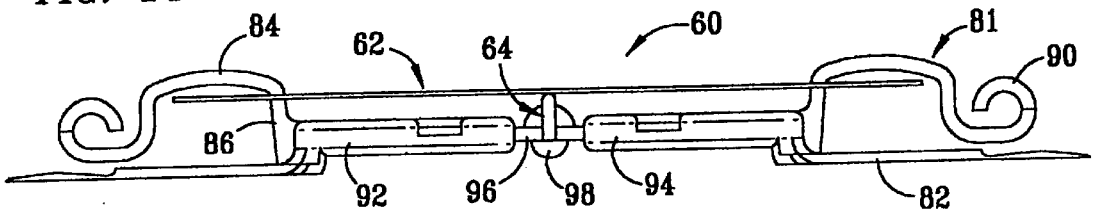
FIG. 14 is a bottom view of the molded product display system of FIG. 7.

As shown in FIGS. 7–9 and 14, molded product portion 64 preferably further comprises a plurality of molded plastic parts, clips 81, that are each connected at two attachment points 39 to tabs 96. Molded plastic clips 81 are more completely depicted in Ser. No. 29/089689, filed Jun. 19, 1998, which is incorporated herein by reference, and are particularly useful for supporting the bulb and socket assemblies of decorative light strings on a building structure. Each molded plastic clip 81 preferably further comprises a base member 82, a resilient arm 84 connected at one end to base member 82 by substantially vertical post member 86, and a resilient hook portion 90 disposed at the free end of resilient arm 84. Clips 81 are preferably molded together with longitudinal runner 98 in an array comprising a single layer of molded plastic products, and are oriented in such manner that base members 82 are substantially coplanar. Although, as seen in FIGS. 8 and 14, the thickness of clips 81 and the overall thickness of Molded product portion 64 are substantially greater than the thickness of display card 62, the total thickness of molded product display system 60 is less than might be experienced, for example, with a display system of comparable length and width, and having a blister pack containing the same number of clips 91.

The attachment of display card 62 to molded product portion 64 is further described in relation to FIGS. 7–10 and 14. During the assembly of molded product display system 60 at the point of manufacture, display card 62 is desirably placed face down over a support frame having rigid bars disposed between the slits (or slots) 112 along the sides of the card. Molded product portion 64 is then aligned so that substantially vertical posts 86 are disposed over apertures 106 of display card 62 and resilient arms 84 are disposed over slits 112. Molded product portion 64 is then pressed downward, causing slits 112 to open or separate as resilient arms 84 pass downward. As the plane of resilient arms 84 drops below the plane of display card 62, substantially vertical posts 86 are received into cooperatively sized apertures 106, thereby attaching display card 62 to molded product portion 64 to complete the assembly. Recesses 108 are preferably slightly wider than the width of resilient arms 84 and hooks 90 to provide some additional tolerance and to facilitate the attachment of display card 62 to molded product portion 64.

While the molded product display system of the invention is described herein using molded plastic clips as the molded product, it will be appreciated upon reading this disclosure that many other types of plastic parts having many different end uses can be similarly manufactured and displayed using the molded product display system of this invention. According to other alternatives, more than one type of molded plastic part can be included in a single molded array, and, depending upon the number, size and configuration of the molded plastic parts, the size and shape of the display card and the preferred aperture configuration can vary substantially from that disclosed herein without departing from the scope of the invention.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

What is claimed is:

1. A molded product display system comprising the combination of an array of interconnected elements including a plurality of tearably releasable, molded plastic product parts, and a display card detachably connected to the array, the display card further comprising a plurality of apertures positioned to receive elements of the array and thereafter restrict motion of the display card relative to the array, wherein the molded plastic product parts include clips for supporting decorative light strings.

2. A molded product display system comprising the combination of an array of interconnected elements including a plurality of tearably releasable, molded plastic product parts, and a display card detachably connected to the array, the display card further comprising a plurality of apertures positioned to receive elements of the array and thereafter restrict motion of the display card relative to the array, wherein the molded plastic product parts include clips for supporting decorative bulb and socket assemblies.

3. A molded product display system comprising the combination of:

a molded array of interconnected plastic elements including at least one mold runner, a plurality of molded plastic product parts detachable from the array, and a molded support member connected to the at least one mold runner, the support member being attachable to a display hanger to support the system during display, and a separate product display card detachably connected to the array, wherein the molded plastic product parts include clips that, when detached from the array, are useful for supporting decorative bulb and socket assemblies.

4. A molded product display system comprising the combination of:

a molded array of interconnected plastic elements including at least one mold runner, a plurality of molded plastic product parts detachable from the array, and a molded support member connected to the at least one mold runner, the support member being attachable to a display hanger to support the system during display, and a separate product display card detachably connected to the array, wherein the molded plastic product parts include clips that, when detached from the array, are useful for supporting decorative light strings.

5. The molded product display system of claim 4 wherein the product display card comprises at least one aperture and wherein the molded array comprises at least one member insertable through an aperture.

6. The molded product display system of claim 4 wherein the product display card comprises at least one slot.

7. The molded product display system of claim 4 wherein the support member comprises an aperture.

8. The molded product display system of claim 4 wherein the molded array is injection molded.

9. The molded product display system of claim 4 wherein the molded array is compression molded.

10. The molded product display system of claim 4 wherein each of the molded plastic product parts is connected directly to the at least one mold runner.

11. The molded product display system of claim 4 wherein each of the molded plastic product parts is connected to the at least one mold runner by at least one tab.

12. The molded product display system of claim 4 wherein the molded array comprises a single layer of molded the plastic product parts.

13. The molded product display system of claim 4 wherein the molded array comprises at least one projecting registration member and wherein the product display card comprises at least one cooperating aperture alignable with the registration member to position the card relative to the molded array.

* * * * *

UNITED STATES PATENT AND TRADEMARK OFFICE

CERTIFICATE OF CORRECTION

PATENT NO. : 6,227,365 B1
DATED : May 8, 2001
INVENTOR(S) : Lonnie F. Gary

It is certified that error appears in the above-identified patent and that said Letters Patent is hereby corrected as shown below:

Abstract,
Line 1, delete "-" between "array" and "of".

Column 3,
Line 40, delete "play" and insert -- display -- in place thereof.

Column 4,
Line 49, delete "." prior to "25".
Line 64, delete "thermo compression" and insert -- thermocompression -- in place thereof.

Column 5,
Line 1, delete "joined" and insert -- joinder -- in place thereof.

Column 10,
Line 14, delete "molded the" and insert -- the molded -- in place thereof.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*